US005435279A

United States Patent [19]

Brümmer et al.

[11] Patent Number: 5,435,279

[45] Date of Patent: Jul. 25, 1995

[54] PLASTIC INTAKE PIPE

[75] Inventors: Michael Brümmer, Laudenbach, Germany; Chris Andrews, New London, N.H.; Klaus Döhring, Heidelberg, Germany

[73] Assignee: Firma Carl Freudenberg, Weinheim, Germany

[21] Appl. No.: 83,743

[22] Filed: Jun. 25, 1993

[30] Foreign Application Priority Data

Jul. 4, 1992 [DE] Germany ..... 42 22 020.3

[51] Int. Cl.[6] ..... F02B 75/18

[52] U.S. Cl. ..... 123/184.21; 138/98

[58] Field of Search ..... 138/89, 92, 94, 98; 220/240, 306, 307; 123/184.21; 428/63

[56] References Cited

U.S. PATENT DOCUMENTS 3,044,920 7/1962 Dewar ..... 138/98
4,363,420 12/1982 Andrews ..... 220/307
4,413,654 11/1983 John ..... 138/92

FOREIGN PATENT DOCUMENTS 909785 4/1954 Germany ..... 138/92

OTHER PUBLICATIONS

Euro. Pat 0280122, Treffler et al., Feb. 1988.

*Primary Examiner*—Noah P. Kamen
*Attorney, Agent, or Firm*—Kenyon & Kenyon

[57] ABSTRACT

A method for closing a non-circular opening in a plastic intake pipe of an internal combustion engine with a cover having a shape adapted to that of the opening includes the step of introducing the cover through the opening from outside the pipe by tilting the cover relative to the opening. The cover is then tilted within the plastic intake pipe to such an extent that the cover completely covers both the opening from the inside in a form-locking manner and an edge region of the plastic intake pipe which surrounds the opening.

10 Claims, 3 Drawing Sheets

PLASTIC INTAKE PIPE

BACKGROUND OF THE INVENTION

The invention relates generally to plastic intake pipes for internal combustion engines, and more specifically to a method for closing an opening in a plastic intake pipe with a cover having a shape adapted thereto.

Plastic intake pipes for internal combustion engines are generally known. To produce plastic intake pipes, cores, which are held by a holding device, are in most cases coated by extrusion. Openings, produced during the manufacturing process, remain in the plastic intake pipes after the cores are removed. The openings must be closed for proper functioning. It is known that these openings are circular and are closed by correspondingly developed covers formed from a thermoplastic plastic by friction welding or ultrasonic welding. It must, however, be noted in this connection that the properties of such plastic intake pipes when in use are quite unsatisfactory. The previously known plastic intake pipes are particularly sensitive to excess pressure which is present in the intake pipe when, for instance, the combustion pressure backfires into the intake pipe due to irregularities in the combustion of the internal combustion engine. In this case, the covers are frequently no longer held fast in the opening and this adversely affects the properties relating to the use of the internal combustion engine.

The present invention is directed to providing a plastic intake pipe and a method for closing the openings therein such that the above-mentioned disadvantages no longer occur. The intake pipe is to withstand an excess pressure that may occur when the combustion pressure backfires into the intake system.

SUMMARY OF THE INVENTION

The present invention provides a method for closing a non-circular opening in a plastic intake pipe of an internal combustion engine with a cover having a shape adapted to that of the opening. According to the method, the cover is introduced through the opening from outside thereof by tilting the cover relative to the opening. The cover is then tilted within the plastic intake pipe to such an extent that the cover completely covers both the opening from the inside in a form-locking manner and an edge region of the plastic intake pipe which surrounds the opening.

According to one aspect of the present invention, the plastic intake pipe has good durability even upon the introduction Of excess pressure that may be applied, for instance, when the combustion pressure spreads into the intake system due to an improperly adjusted internal combustion engine. To provide this feature, non-circular openings in the plastic intake pipe of an internal combustion engine are closed by covers of adapted shape in the manner that the cover is introduced turned from the outside through the opening and is then turned back in the intake pipe to such an extent that it completely covers the opening and an edge region of the intake pipe surrounding the opening from the inside by form-locking. The cross-sectional area of the opening is smaller than the area of the cover. It is advantageous in this connection that the plastic intake pipe has good resistance to any possibly occurring excess pressures. The cover is attached from the inside on the edge region of the intake pipe which surrounds the opening.

In accordance with another advantageous aspect of the invention, the opening and the cover may both be oval, the ratio of the main axis to the secondary axis being advantageously 1.1:1 to 3:1. In this case the installation of the cover is particularly simple. With this approach canting upon the installation of the cover in the opening can be avoided. Depending on the circumstances of the application in question, and in particular on the cross-section of the passage within the intake pipe, the dimensions of the cover and opening must be adapted to each other.

One aspect of the invention that is particularly favorable from the standpoint of manufacture and economy, results from providing an opening and a cover which are substantially angular. For example, the shape of the opening and cover can be square, Polygonal shapes differing therefrom are also possible. In order to close the opening from the inside, the cover is first of all rotated out of the plane of the opening by 90° into a plane perpendicular thereto, and then is tilted by 45° so that it can then be diagonally guided through the opening. Within the intake pipe the cover is then moved back into its initial position until it completely covers the opening. Finally, the cover is fastened to the edge region of the opening.

To attach the cover, the side of the cover facing the opening can be coated, at least in part, with an adhesive to glue the cover on from the inside at the edge region surrounding the opening. Such a connection readily withstands the relatively slight vacuum within the intake pipe. Any excess pressure existing within the intake system cannot drive the cover out of the plastic intake pipe due to the larger cross-section of the cover relative to the opening. As a result, the operability of the internal combustion engine is maintained and the plastic intake pipe is not damaged. If required, the opening and/or the cover can be provided with a liquid seal on their sides facing each other. This assures that the intake pipe is reliably sealed off from the environment.

In accordance with another aspect of the invention, the cover may be formed from a thermoplastic plastic and has, on its side facing the opening, integrally formed projections that can be brought into engagement with the edge region of the opening by vibration welding. Upon vibration welding, the contact surfaces of the parts to be welded together, in this case the edge region which delimits the opening and the cover, must be developed in such a manner that the melt which forms has a free space on all sides to form a weld bead. The melt then extends upon the vibration welding on the circumference along the edge region, attaches the cover and seals off the opening of the plastic intake pipe.

In accordance with yet another aspect of the invention, the cover has a catch device that can be secured from the inside into the opening to be closed. The catch device may, for instance, be formed from several barb-like claws which are formed on the circumference of the cover. The claws surround the edge region of the opening with an initial axial pretension. This feature is simple from a manufacturing standpoint since the edge region of the production-induced opening can be used as an abutment. However, it is also possible to snap the cover into a separately produced opening intended for this particular purpose.

To improve the seal, particularly when using a cover with a catch device, the cover may be provided with at least one groove which is open in the direction towards the opening. The groove surrounds the circumference of the opening and a seal can be inserted therein. The seal may be formed, for example, from an 0-ring, which has good properties even after a long period of use and under differing loads. In addition to 0-ring seals which can be inserted into the groove, a liquid seal such as silicon may also be used, which is arranged between the cover and the edge region around the opening.

To simplify the installation of the cover in the plastic intake pipe, the cover can have an integrally formed holding device such as a holding knob, for instance, which is centrally arranged on the side of the cover facing away from the intake pipe. This feature facilitates final assembly by machine.

DETAILED DESCRIPTION

Figure 1:
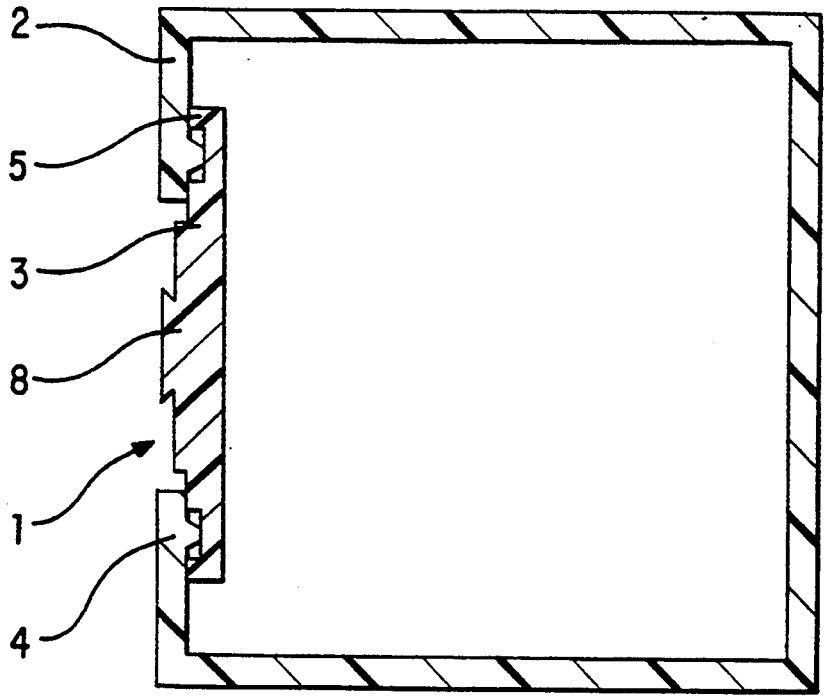
FIG. 1 illustrates a sectional view of the plastic intake pipe constructed according to the principles of the present invention.
Figure 2:
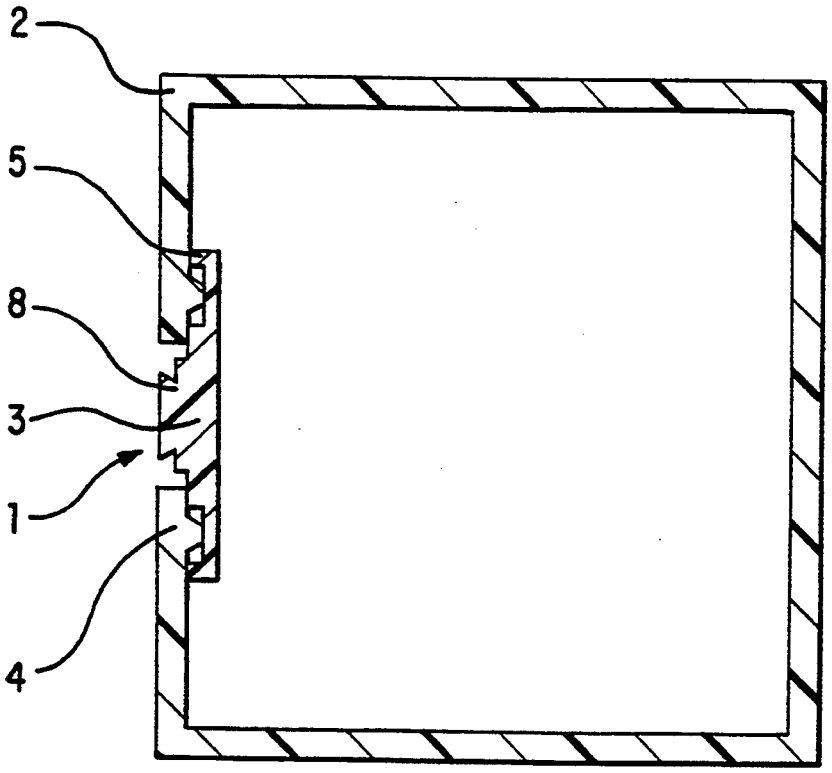
FIG. 2 illustrates the plastic intake pipe of FIG. 1 rotated by 90° thereto.

The embodiment of the invention illustrated in FIGS. 1 and 2 show a plastic intake pipe 2 which has an opening 1 produced upon manufacturing which is closed from the inside by a cover 3. As seen in FIGS. 1 and 2, the cover 3 completely covers the opening 1 formed in the plastic intake pipe 2. Both the opening 1 and the cover 3 have a non-circular cross-section so that the relatively larger cover can be passed through the opening 1 by revolving or rotating the cover 3. The cover 3 can then be positioned in such a manner that it closes the opening 1 in gas-tight manner from the inside of the plastic intake pipe 2. In this embodiment the cover 3 is formed from a thermoplastic plastic and includes projections 5 that are oriented in the direction toward the edge region 4 of the opening 1. The projections 5 are at least partially melted off upon vibration welding and thus can be brought into engagement with the intake pipe 2. The cover 3, which has been attached by vibration welding, is held onto the plastic intake pipe 2 permanently and in gas-tight manner.

Figure 3:
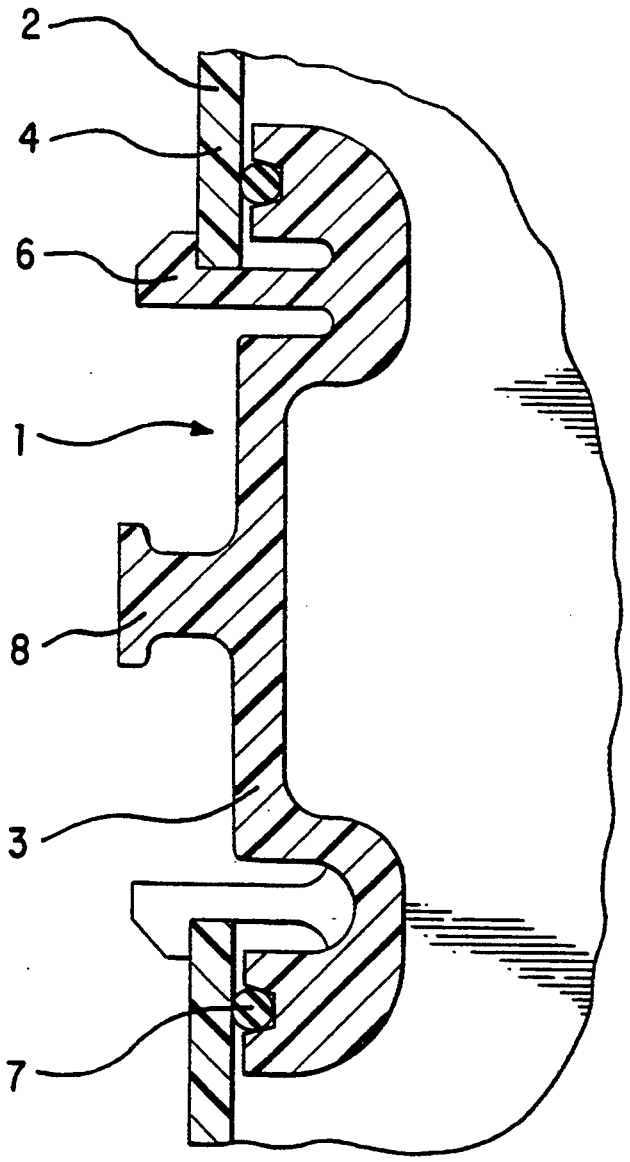
FIG. 3 illustrates an alternative embodiment of the invention in which the cover is snapped into the intake pipe in an edge region surrounding the opening.

In the embodiment of the invention shown in FIG. 3, the cover 3 has a barb-like catch device 6 formed in the edge region 4 of the plastic intake pipe 2. The cover 3 has a circumferential groove which is open in the direction towards the opening 1. A seal 7, in this case an O-ring, is inserted into the groove to reliably seal off the non-circular cover 3 in the non-circular opening 1. The cover has in its central region a holding device 8 for better handling during the installation process. As in the first embodiment, the cover 3 and the intake pipe 2 are formed of plastic.

Figure 4:
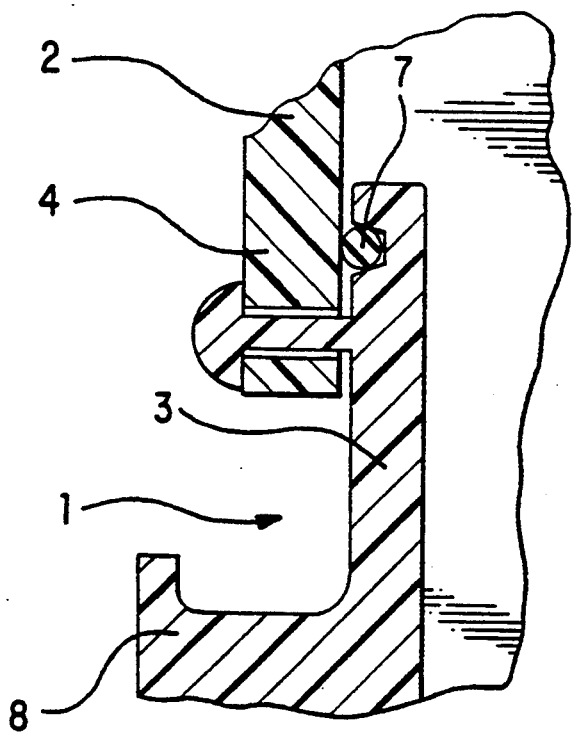
FIG. 4 illustrates an embodiment similar to the embodiment of FIG. 3, but in which the cover is deformed by a method similar to riveting in the case of metallic materials to hold it in the edge region of the intake pipe.

FIG. 4 shows an embodiment of the invention which is similar to the embodiment of FIG. 3. Instead of the catch device 6, this embodiment employs pins that are formed in an integral manner with the cover and which, after the introduction of the cover 3 into the plastic intake pipe 2, are guided through recesses in the edge region 4 and are then deformed in such a manner that the cover 3 reliably seals off the opening 1 upon the action of vacuum and excess pressure.

The plastic intake pipe of the invention exhibits good properties when in use during a long service life.

What is claimed is:

1. A method for closing a non-circular opening in a plastic intake pipe of an internal combustion engine with a cover having a shape adapted to that of the opening, said method comprising the steps of: introducing the cover through the opening from outside thereof by tilting the cover relative to the opening; and tilting the cover within the plastic intake pipe to such an extent that the cover completely covers the opening from the inside in a form-locking manner and an edge region of the plastic intake pipe which surrounds the opening.

2. The method of claim 1 wherein the the opening has a cross sectional area smaller than the area of the cover.

3. The method of claim 2 wherein the opening and the cover both have an oval shape with a ratio of the main axis to the secondary axis of 1.1:1 to 3:1.

4. The method of claim 3 wherein the cover is formed from a thermoplastic plastic and further comprising integrally formed projections disposed on the side of the cover facing the opening which can be brought into engagement with the plastic intake pipe by vibration welding.

5. The method of of claim 4 wherein the cover has a groove that is open in a direction facing the opening and which surrounds the circumference of the opening, said groove being adapted to contain a seal insertable therein.

6. The method of claim 5 wherein the cover has an integrally formed holding device.

7. The method of claim 2 wherein the opening and the cover are substantially angular in shape.

8. The method of claim 7 wherein the opening and the cover have a square shape.

9. The method of claim 7 wherein the cover has a catch device that can be snapped into the opening to be closed.

10. The method of claim 2 wherein the cover has an adhesive coating at least partially covering the side of the cover facing the opening.

* * * * *